US005359188A

United States Patent [19]

Kubo et al.

[11] Patent Number: 5,359,188

[45] Date of Patent: Oct. 25, 1994

[54] X-RAY IMAGE INTENSIFIER

[75] Inventors: Hiroshi Kubo, Utsunomiya; Atsuya Yoshida, Ootawara; Hiroki Tanaka, Kyoto; Shin Tsuchida, Nagoya, all of Japan

[73] Assignees: Kabushiki Kaisha Toshiba, Kawasaki; Sumitomo Light Metal Industries, Ltd., Tokyo, Japan

[21] Appl. No.: 40,645

[22] Filed: Mar. 31, 1993

[30] Foreign Application Priority Data

Mar. 31, 1992 [JP] Japan ..... 4-074810

[51] Int. Cl.[5] ..... H01J 40/14

[52] U.S. Cl. ..... 250/214 VT; 250/484.4

[58] Field of Search ..... 250/214 VT, 484.1; 420/535, 541, 543; 313/523, 525, 543

[56] References Cited

U.S. PATENT DOCUMENTS 4,153,854 5/1979 Christagau et al. .
4,331,898 5/1982 Shimizu et al. .
4,516,715 5/1985 Sugimori et al. .
4,575,635 3/1986 Arakawa et al. ..... 250/484.4

FOREIGN PATENT DOCUMENTS 0191664 8/1986 European Pat. Off. .
0471206 2/1992 European Pat. Off. .
2245591 1/1992 United Kingdom .

*Primary Examiner*—David C. Nelms
*Assistant Examiner*—K. Shami
*Attorney, Agent, or Firm*—Cushman, Darby & Cushman

[57] ABSTRACT

An X-ray image intensifier includes an envelope having an input window consisting of an aluminum alloy, and an input phosphor screen arranged in the envelope to oppose the input window, and including a substrate, an input phosphor layer formed on the substrate, and a photocathode formed on the input phosphor layer, wherein the aluminum alloy contains 3 to 6 wt % of Mg and 0.01 to 0.5 wt % of Zr. This aluminum alloy may further contain at least one metal element selected from the group consisting of 0.1 to 1 wt % of Mn, 0.01 to 0.5 wt % of Cr, 0.01 to 0.5 wt % of Sc, and 0.01 to 0.05 wt % of Ti.

16 Claims, 3 Drawing Sheets

X-RAY IMAGE INTENSIFIER

BACKGROUND OF THE INVENTION

1. Field of the Invention

The present invention relates to an X-ray image intensifier and, more particularly, to an X-ray image intensifier suitable for low-energy X-ray photography.

2. Description of the Related Art

An X-ray image intensifier is used to obtain an X-ray transmitted image of an object to be examined in an X-ray diagnostic apparatus or the like. The material constituting an input window of the X-ray image intensifier is naturally required to transmit x-rays well and cause less scattering of x-rays. In addition, since the interior of the X-ray image intensifier is in a vacuum, the input window is required to have an enough strength to withstand this vacuum. The input window is also required to be well balanced in cost with other components that constitute the X-ray image intensifier.

Aluminum or titanium has been used as the material of the input window, that can meet the above conditions.

The X-ray image intensifiers are presently, widely used in the fields of, e.g., medical diagnoses and industrial applications (e.g., nondestructive testing). These X-ray image intensifiers have various excellent features that they can convert a moving x-ray image into a visible image in real time and can reduce the exposure dose compared to systems using films. This extends the range of applications of the X-ray image intensifiers.

Recently, in the field of medical diagnoses, researchers have investigated the use of the X-ray image intensifier in diagnoses of breast cancers. Since the diagnosis of a breast cancer is testing on a soft tissue, relatively low-energy X-rays, such as those generated at an X-ray intensifier voltage of approximately 20 KV to 40 KV, are used. Also, in the field of industrial applications (e.g., nondestructive testing), researchers have investigated the use of low-energy X-rays in testing on products made of paper or resins.

In applying low-energy X-rays, the transmittance of an input window of the X-ray image intensifier with respect to X-rays is of primary concern. The X-ray transmittance is determined by the material and the thickness of an input window and the energy of X-rays: the higher the energy of X-rays or the smaller the thickness of a window, the higher the transmittance. Also, an element having a smaller atomic number generally has a higher x-ray transmittance.

FIG. 1 shows the X-ray transmittances of aluminum and titanium used as the material of the input window of the X-ray image intensifier. Referring to FIG. 1, the X-ray transmittance (%) is plotted on the ordinate, and the X-ray energy (KeV) is plotted on the abscissa. A broken curve a indicates the X-ray transmittance of aluminum (thickness 1 mm), and a solid curve b indicates that of titanium (thickness 250 $\mu$m).

When titanium is to be used as the material of the input window, the thickness of titanium must be decreased to about 250 $\mu$m in order to obtain a practically sufficient X-ray transmittance. An input window consisting of a material with such a small thickness in a finished X-ray image intensifier assumes a recessed outer appearance owing to a differential pressure with respect to the atmospheric pressure, because the interior of the tube is in a vacuum. To assemble this titanium input window into the X-ray image intensifier, the input window is joined with a stainless-steel ring by spot welding. This stainless-steel ring is then welded to an Fe—Ni—Co alloy ring which is in turn joined with a glass container as a part of an envelope.

When aluminum is used as the material of the input window, on the other hand, the input window is welded to a stainless-steel ring at a predetermined temperature and under a predetermined pressure. Since, however, the mechanical strength of aluminum is smaller than that of titanium, the thickness of aluminum is set to about 1 mm. In addition, in order to withstand the atmospheric pressure, the outer surface of the input window is projected.

As shown in FIG. 1, the transmittance of aluminum is higher than that of titanium for x-rays with a low energy of 20 KeV to 40 KeV. Therefore, when the energy of X-rays is low, aluminum is a more suitable material of the input window than titanium. Aluminum materials are classified into various types in accordance with the types and the amounts of additive substances contained in them and the conditions of treatments. These materials are also different in mechanical and thermal characteristics. According to literature such as "Aluminum HandBook," the aluminum materials are classified as follows: (A.A. shows a grade determined by the Aluminum Association, Inc.)

A.A.#1000 type: Pure aluminum. Aluminum with a purity of 99% or more. Processability, corrosion resistance, and weldability are high, but strength is low.

A.A.#2000 type: Al—Cu alloy. Duralumin. Strength is high, but corrosion resistance is poor.

A.A.#3000 type: Al—Mn alloy. Strength is slightly increased by adding Mn to the #1000 type.

A.A.#4000 type: Al—Si alloy. Abrasion resistance and heat resistance are improved by addition of Si.

A.A.#5000 type: Al—Mg alloy. Strength is high.

A.A.#6000 type: Al—Mg—Si alloy. Both strength and corrosion resistance are high.

A.A.#7000 type: Al—Zn—Mg alloy. Strength is highest of all aluminum alloys, but formability is poor.

Conditions required for the material constituting an input window of an X-ray image intensifier are as follows:

(a) Having an enough strength to withstand the atmospheric pressure.

(b) Having an enough strength to withstand the atmospheric pressure not only at room temperature but at the baking temperature (200° C. to 400° C.) in an exhaust step as one of the steps of manufacturing X-ray image intensifiers.

(c) Having a sufficient corrosion resistance.

(d) Having a high formability in order to form the input window into a projecting shape.

Aluminum materials meeting these conditions are those of the A.A.#5000 type and the A.A.#6000 type, and these materials are actually used.

As described above, the input window is joined to the stainless-steel ring in the process of manufacturing the X-ray image intensifier. In this case, the aluminum material constituting the input window and the stainless-steel ring are joined together at a temperature of 400° C. or more and under a predetermined pressure. This joining is performed by diffusing molecules of the aluminum material and the stainless steel into each other at a high temperature and a high pressure. Since the temperature of the aluminum material rises, a certain change occurs inside the aluminum material. As an example, in the case of the A.A.#6000 type aluminum material, an $Mg_2Si$ precipitate forms while the temperature falls from the high temperature in the joining, and in the step of baking at about 250° C. This state will be described with reference to FIGS. 2A and 2B.

Generally, when aluminum is kept at a high temperature, Al crystal grains grow into coarse grains 21 as shown in FIG. 2A, and, in the middle of cooling from the high temperature, $Mg_2Si$ phases 22 precipitate in grain boundaries as shown in FIG. 2B (especially in the A.A.#6000 type). This precipitate 22 is different in X-ray transmittance from aluminum. This difference in X-ray transmittance between the precipitate and aluminum is negligibly small when the energy of X-rays is 50 KV or more, if, however, the X-ray energy becomes 30 KV or less, the difference in X-ray transmittance between the two increases. Consequently, even when uniform X-rays are incident on the input window, the amount of transmitted X-rays changes in accordance with the presence/absence of the precipitate.

When, therefore, an aluminum material containing the precipitates is directly formed into an input window, the presence of the precipitates gives rise to unevenness corresponding to the distribution of the precipitates in a visible-light image produced by the X-ray image intensifier. In addition, in the A.A.#5000 type aluminum material, recrystallization of aluminum occurs at the high temperature to produce coarse crystal grains of aluminum inside the aluminum material. The coarse crystal grain of aluminum is different in crystal orientation from the surrounding aluminum. Therefore, X-ray diffraction conditions vary in accordance with the incident direction of X-rays, and this produces a difference in X-ray transmittance between the two types of aluminum. Also in this case, when the energy of X-ray becomes low, a large difference arises in X-ray transmittance between a portion containing the coarse crystal grains and a portion not containing them, as in the A.A.#6000 type aluminum.

Assuming that the thickness of aluminum is $t_1$, an X-ray transmittance $T_1$ is represented by:

$$T_1 = exp(-\mu t_1)$$

Likewise, assuming that the thickness of aluminum is $t_2$, an X-ray transmittance $T_2$ is given by:

$$T_2 = exp(-\mu t_2)$$

The ratio of one transmittance to the other is, therefore, $T_1/T_2 = \exp[\mu(t_2 - t_1)]$.

In the above relation, $\mu$ is the transmittance coefficient corresponding to the energy of X-rays.

Note that if $t_2 > t1$, the value of $\mu(t_2 - t_1)$ is positive, and so $T_1/T_2 > 1$. In addition, since $\mu$ increases as the X-ray energy decreases, $T_1/T_2$ increases when the X-ray energy decreases. That is, the lower the energy of X-rays, the larger the transmittance difference (ratio). It is assumed that this relationship produces unevenness in a visible-light image produced by the X-ray image intensifier.

Recently, image processing apparatuses are widely used, and even a slight difference in X-ray transmittance is emphasized in these apparatuses. Hence, there is a high possibility that unevenness in a produced image, which is supposed to result from precipitates or coarse crystal grains as described above, becomes a more serious obstacle in the future.

SUMMARY OF THE INVENTION

It is an object of the present invention to provide an X-ray image intensifier capable of obtaining high-quality images free from unevenness even if low-energy X-rays are used.

According to the present invention, there is provided an X-ray image intensifier comprising an envelope having an input window consisting essentially of an aluminum alloy, and an input phosphor screen arranged in the envelope to oppose the input window, and including a substrate, an input phosphor layer formed on the substrate, and a photocathode formed on the input phosphor layer, wherein the aluminum alloy contains 3 to 6 wt % of Mg and 0.01 to 0.5 wt % of Zr.

In addition, according to the present invention, there is provided an X-ray image intensifier comprising an envelope having an input window consisting essentially of an aluminum alloy, and an input phosphor screen arranged in the envelope to oppose the input window, and including a substrate, an input phosphor layer formed on the substrate, and a photocathode formed on the input phosphor layer, wherein the aluminum alloy contains 3 to 6 wt % of Mg, 0.01 to 0.5 wt % of Zr, 0.1 to 0.4 wt % of Fe, 0.05 to 0.2 wt % of Si, and 0.1 to 1 wt % of Mn.

Furthermore, according to the present invention, there is provided an X-ray image intensifier comprising an envelope having an input window consisting essentially of an aluminum alloy, and an input phosphor screen arranged in the envelope to oppose the input window, and including a substrate, an input phosphor layer formed on the substrate, and a photocathode formed on the input phosphor layer, wherein the aluminum alloy contains 3 to 6 wt % of Mg, 0.01 to 0.5 wt % of Zr, 0.1 to 0.4 wt % of Fe, 0.05 to 0.2 wt % of Si, and 0.1 to 1 wt % of Mn and at least one type of metal elements .selected from the group consisting of 0.01 to 0.5 wt % of Cr, 0.01 to 0.5 wt % of Sc, and 0.01 to 0.05 wt % of Ti, contains five or more grains of intermetallic compound with an average diameter of 0.01 to 0.05 $\mu m$ per $\mu m^3$, and has material strength of 120 MPa or more at 250° C. or less, and the crystal grain size is 30 $\mu m$ or less when a heat treatment is performed at 530° C. for less than one hour.

Furthermore, there is provided aluminum alloy having substantially uniform X-ray transmittance, and comprising 3 to 6 wt % of Mg, 0.01 to 0.5 wt % of Zr, at most 0.4 wt % of Fe, and at most 0.2 wt % of Si.

Furthermore, there is provided a method of manufacturing aluminum alloy having substantially uniform X-ray transmittance, which comprises the steps of:

nomogenizing an aluminum cast comprising 3 to 6 wt % of Mg, 0.01 to 0.5 wt % of Zr, at most 0.4 wt % of Fe, and at most 0.2 wt % of Si, at a temperature of 400° to 530° C. for 1 to 20 hours;

hot rolling the aluminum alloy cast to form a aluminum alloy plate;

thermal-treating the hot-rolled aluminum alloy plate for recrystallization; and cold rolling the thermal-treated aluminum alloy plate at a reduction ratio of 10% or more.

The cold-rolled aluminum alloy plate may be thermal-treated for recovering an elongation.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
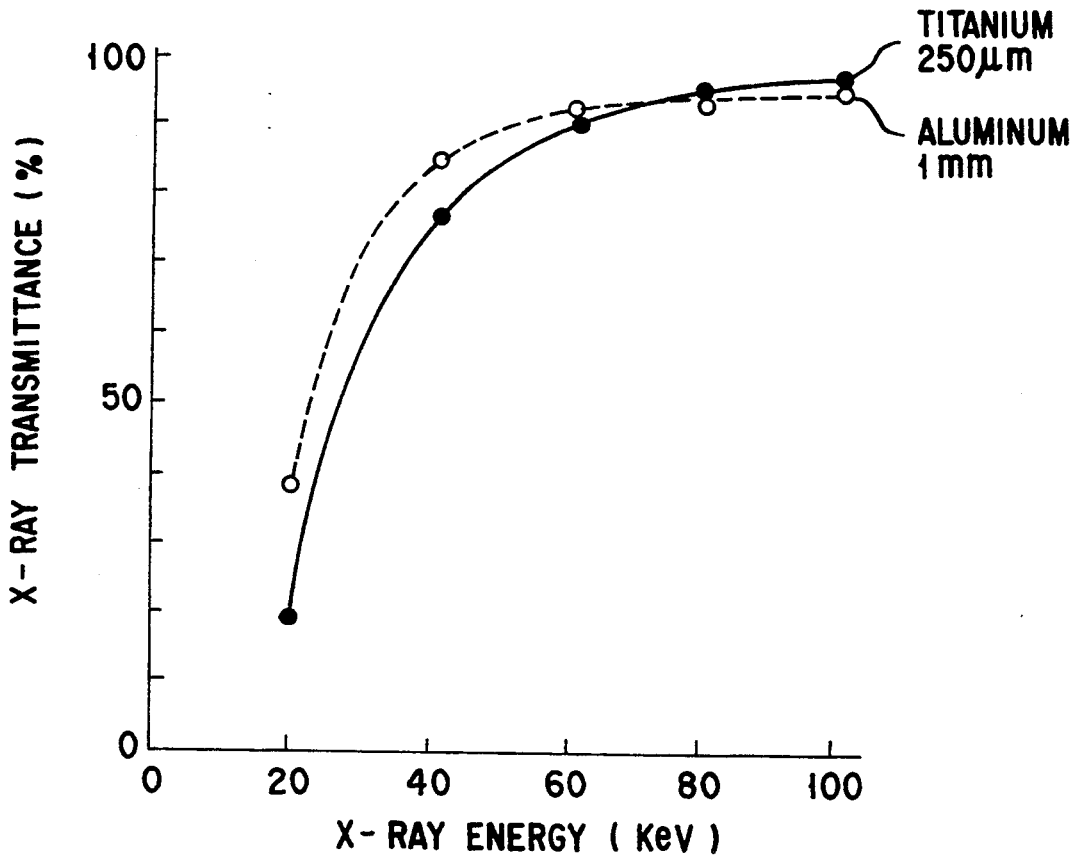
FIG. 1 is a graph showing the X-ray transmittances of aluminum and titanium.

In an X-ray image intensifier of the present invention, an aluminum alloy containing 3 to 6 wt %, preferably 4 to 5 wt % of Mg and 0.01 to 0.5 wt %, preferably 0.05 to 0.2 wt % of Zr is used as the material of an input window.

Mg is the most basic additive element of the aluminum alloy used in the present invention and serves to increase the strength. If the addition amount of Mg is less than 3 wt %, the material strength at 250° C. becomes 120 MPa or less; i.e., strength required to decrease the thickness of the input window to 0.8 mm or less cannot be obtained. If the addition amount of Mg exceeds 6 wt %, the aluminum alloy becomes liable to crack during hot rolling. This makes industrial application of the aluminum alloy difficult.

Zr precipitates uniformly and finely as $Al_3Zr$ phases during homogenization of the aluminum alloy to prevent crystal grains from coarsening while they are held at a high temperature during diffusion joining. If the addition amount of Zr is less than 0.01 wt %, Zr cannot function in this way; if the addition amount of Zr exceeds 0.5 wt %, a coarse $Al_3Zr$-phase compound becomes easier to form, producing a density unevenness in a visible-light image obtained by the X-ray image intensifier. This density unevenness may be mistaken for defects in an object to be examined.

The aluminum alloy used in the present invention may further contain one or more of Mn, Cr, Sc, and Ti as additive components.

Mn serves to increase the strength as does Mg. In addition, similar to Zr, Mn has an effect of suppressing coarsening of crystal grains while they are held at a high temperature during diffusion joining. Using Mn in combination with Zr can further suppress coarsening of crystal grains than when Zr alone is used. The addition amount of Mn is 0.1 to 1.0 wt %, and preferably 0.3 to 0.6 wt %. If the addition amount is less than 0.1 wt %, Mn cannot achieve its function; if the addition amount exceeds 1.0 wt %, the aluminum alloy becomes liable to crack during hot rolling. This makes industrial application of the aluminum alloy difficult. Furthermore, if the addition amount exceeds 1.0 wt %, Mn bonds to Fe as an impurity during preparation of a bulk material to allow easy formation of a coarse Al—Fe—Mn compound. The result is a density unevenness in a visible-light image obtained by the X-ray image intensifier. This density unevenness may be mistaken for defects in an object to be examined.

Similar to Zr, Cr precipitates uniformly and finely as $Al_7Cr$ phases during homogenization of the aluminum alloy to prevent crystal grains from coarsening when they are kept at a high temperature during diffusion joining. Note that the $Al_7Cr$ phase is easier to coarsen than the $Al_3Zr$ phase. The addition amount of Cr is 0.01 to 0.5 wt %, and preferably 0.05 to 0.2 wt %. If the addition amount is less than 0.01 wt %, Cr cannot achieve its effect; if the addition amount exceeds 0.5 wt %, a coarse $Al_7Cr$-phase compound becomes easier to form, producing a density unevenness in a visible-light image obtained by the X-ray image intensifier. This density unevenness may be mistaken for defects in an object to be examined.

Sc, similar to Zr and Cr, precipitates uniformly and finely as $Al_3Sc$ phases during homogenization of the aluminum alloy to suppress coarsening of crystal grains when they are kept at a high temperature during diffusion joining. The addition amount of Sc is 0.01 to 0.5 wt %, and preferably 0.05 to 0.2 wt %. If the addition amount is less than 0.01 wt %, Sc cannot achieve its function; if the addition amount exceeds 0.5 wt %, a coarse $Al_3Sc$-phase compound becomes easier to form, producing a density unevenness in a visible-light image obtained by the X-ray image intensifier. This density unevenness may be mistaken for defects in an object to be examined. In addition, since Sc is an expensive material, the manufacturing cost is increased if the addition amount of Sc exceeds 0.5 wt %.

Ti has an effect of forming fine crystal grains in a cast mass texture. Ti also has an effect of uniformizing the sizes of crystal grains during hot rolling. The addition amount of Ti is 0.01 to 0.05 wt %, and preferably 0.01 to 0.03 wt %. If the addition amount is less than 0.01 wt %, Ti cannot achieve its effects; if the addition amount exceeds 0.05 wt %, a coarse $Al_3Ti$-phase compound becomes easier to form, producing a density unevenness in a visible-light image obtained by the X-ray image intensifier. This density unevenness may be mistaken for defects in an object to be examined.

The aluminum alloy for use in the present invention may contain 0.1 to 0.4 wt % of Fe and 0.05 to 0.2 wt % of Si. Fe and Si are normally impurities contained in an aluminum base metal. If the content of Fe exceeds 0.4 wt %, a coarse Al—Fe—Mn compound undesirably becomes easier to form. Although the amount of Fe is preferably decreased, the purity of an Al base metal must be improved to do so, resulting in an increase in manufacturing cost. For this reason, an amount of 0.1 wt % is the lower limit for the Fe content.

If the amount of Si exceeds 0.2 wt %, $Mg_2Si$ phases become liable to precipitate nonuniformly, and this produces a density unevenness in a visible-light image obtained by the X-ray image intensifier. A smaller amount of Si is better as in the case of Fe, but the purity of an Al base metal must be improved for this purpose. Since this increases the manufacturing cost, an amount of 0.1 wt % is the lower limit for the Si content.

The aluminum alloy constituting the input window of the X-ray image intensifier of the present invention is normally subjected to homogenization. The homogenization is performed to control the dispersion state of transition-element intermetallic compounds ($Al_3Zr$, $Al_7Cr$, and $Al_3Sc$).

The temperature of the homogenization process is preferably 400° to 530° C. If the homogenization temperature is less than 400° C., the precipitation rates of the above intermetallic compounds decrease significantly. This prolongs time required for the compounds to reach the target dispersion state, resulting in an industrial disadvantage. If the homogenization temperature exceeds 530° C., the intermetallic compounds become easier to coarsen, and this impairs the effect of suppressing coarsening of crystal grains.

In addition, if the Mg concentration is high, eutectic melting occurs during the homogenization, and consequently the aluminum alloy undesirably becomes liable to crack during hot rolling.

When the homogenization temperature falls within the range from 400° to 530° C., the homogenization time is preferably one to 20 hours. If the homogenization time is less than one hour, the transition-element intermetallic compounds cannot be set in a desired dispersion state. This makes it difficult to suppress coarsening of crystal grains during diffusion joining. A homogenization time exceeding 20 hours is unpreferable because not only it is industrially disadvantageous but it leads to coarsening of the above intermetallic compounds.

The dispersion state of the transition-element intermetallic compounds can be controlled by the conditions of the homogenization. To suppress coarsening of crystal grains during diffusion joining (a heat treatment at 530° C. or less for less than one hour), five or more compound particle of a size of 0.01 to 0.05 μm need only exist per 1 $\mu m^3$. If the number is less than five, the size of Al crystal grains becomes 100 μm or more during diffusion joining, producing a density unevenness in a visible-light image obtained by the X-ray image intensifier.

If crystal grains exceeding 100 μm in diameter are present in the aluminum alloy used in the present invention, a density unevenness is undesirably produced in a visible-light image obtained by the X-ray image intensifier. No such problem arise if the crystal grain size is 30 μm or less.

An X-ray diagnostic apparatus using the X-ray image intensifier of the present invention will be described below with reference to FIG. 3.

Figure 3:
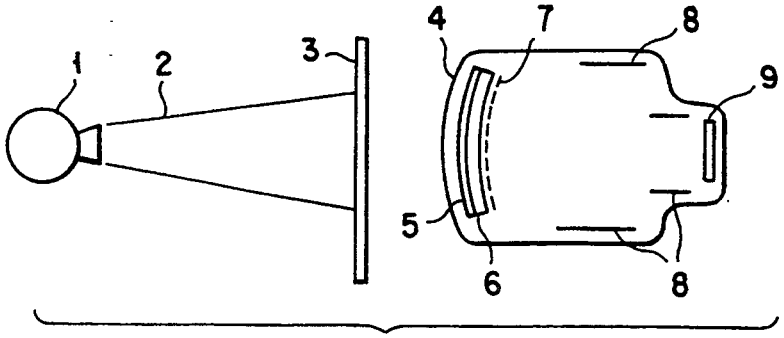
FIG. 3 is a view showing an X-ray diagnostic apparatus using an X-ray image intensifier according to the present invention.

Referring to FIG. 3, X-rays 2 radiated from an X-ray image intensifier 1 are transmitted through an object 3 to be examined. The X-rays 2 transmitted through the object 3 are incident on an input phosphor screen through an input window 4 of an envelope constituting the X-ray image intensifier. Note that the input 10 window 4 of the X-ray image intensifier is made of a metal, and the input phosphor layer is on an input substrate 5, the input phosphor layer 6 converts X-rays into light and a photocathode 7 converts light into electrons.

Electrons radiated from the photocathode 7 are accelerated and converged by electron lenses consisting of electrodes 8, reaching an output phosphor layer 9. The output phosphor layer 9 converts the electrons into visible light. This visible light is photographed by using a film or a TV camera to perform an X-ray diagnosis.

Figure 4:
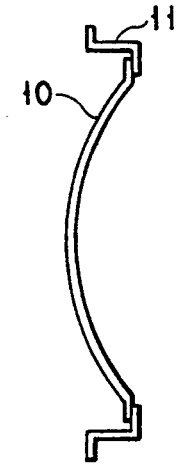
FIG. 4 is a view showing an input window of the X-ray image intensifier of the present invention.

FIG. 4 shows a portion of the input window of the X-ray image intensifier according to the present invention. Reference numeral 10 denotes the input window of the X-ray image intensifier, which is joined to a stainless-steel ring 11.

The material of the input window 10 is an aluminum alloy produced by adding 0.15 wt % of chromium and 0.15 wt % of zirconium, both in weight ratio, to an Al—Mg alloy of the A.A.#5000 group. An aluminum material consisting of this aluminum alloy is stretched by about 20% into a plate beforehand and projected as shown in FIG. 4.

Since the aluminum material contains 0.15 wt % of chromium and 0.15 wt % of zirconium, precipitates of these contents are dispersed in the material. When the precipitates of the contents are exposed to a high temperature of 400° to 500° C. in order to join the input window consisting of this aluminum material to the stainless-steel ring, the precipitates function to suppress coarsening of aluminum crystals formed inside the aluminum material. Therefore, no nonuniformity in X-ray transmittance arises in the input window consisting of the aluminum material in which growth of coarse aluminum crystal grains is suppressed.

Figures 2A, 2B:
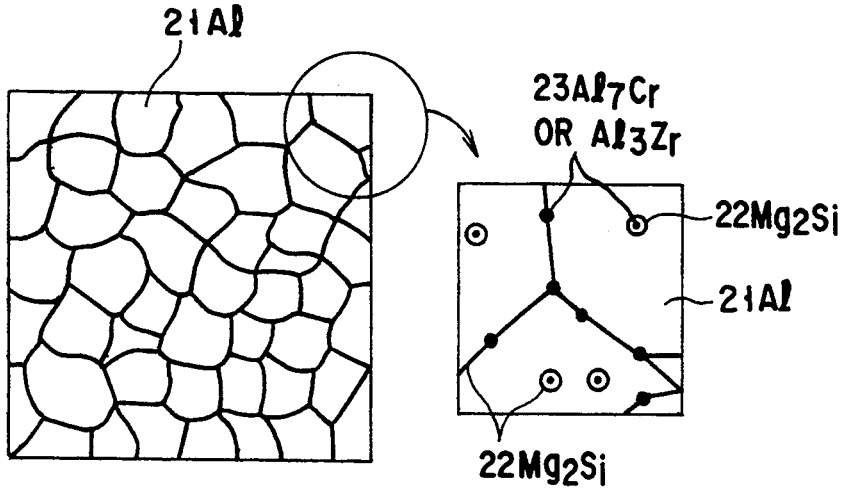
FIG. 2A is a view showing coarsening of Al crystal grains.
FIG. 2B is a view showing a part of FIG. 2A in an coarsened scale.

This state will be described with reference to FIG. 2B. When Zr or the like is added to an Al—Mg alloy, coarsening of Al crystal grains 21 is suppressed by fine $Al_3Zr$ precipitates 23 even if the alloy is held at a high temperature. This effect prevents easy occurrence of unevenness.

Figure 5:
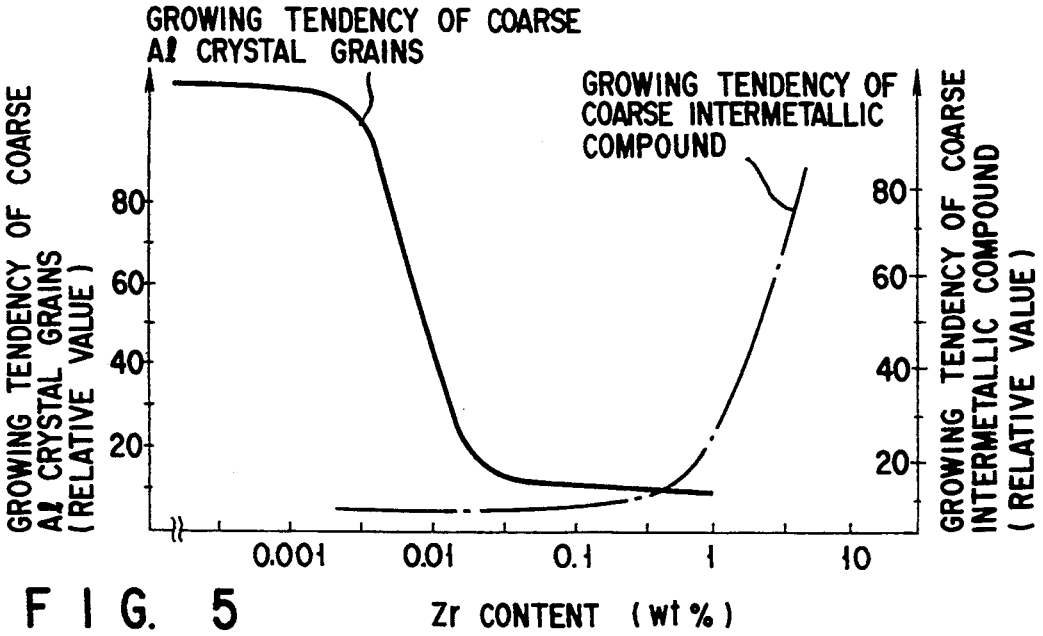
FIG. 5 is a graph showing the relationship among the Zr content, the growing tendency of coarse crystal grains of an aluminum material and the growing tendency of coarse crystal grains of intermetallic compound.

FIG. 5 is a graph showing the correlation among the growing tendency of coarse crystals (Al crystal grains) plotted on the ordinate (left), the growing tendency of coase cryatals (intermetallic compound) on the ordinate (right), and the content (wt %) of Zr on the abscissa. As can be seen from this graph, the growing tendency of Al crystals increases at a welding when the content of Zr is less than 0.01 wt %.

On the other hand, when the content of Zr exceeds 0.5 wt %, a coarse $Al_3Zr$ phase undensirably becomes easier to form.

In addition, in the step of processing the aluminum material into the input window of the X-ray image intensifier, pressing and drawing are performed to form the aluminum material into a projecting shape in order to obtain a structure that can withstand the atmospheric pressure. In this processing, the aluminum material is stretched by about 20%. In this case, the growing tendency of coarse crystal grains at a high temperature changes in accordance with the degree of stretch of the aluminum material: when the aluminum material is stretched, internal strain accumulates in the material, and the density of accumulation of this internal strain increases as the degree of stretch increases.

A sufficiently low strain has no large effect on growth of coarse crystal grains inside aluminum. If, however, the strain increases, this accelerates growth of coarse crystal grains as is well known to those skilled in the art. The growth of coarse crystal grains is maximized when the degree of stretch is 20 to 30% and decreases as the degree increases. Therefore, when the aluminum material is formed into a projecting shape in order to constitute the input window of the X-ray image intensifier, the material is stretched by approximately 20%, accelerating growth of coarse crystal grains.

In the present invention, therefore, an aluminum material already stretched by about 20% is processed into a projecting shape. Consequently, since the aluminum material is stretched by a total of about 40% before and after the processing, formation of coarse crystal grains can be suppressed.

EXAMPLE

A cast mass of an aluminum alloy having the composition to be presented later in a table was homogenized at 480° C. for five hours and subjected to hot rolling at a temperature from 300° to 480° C., forming a plate 2 mm thick. Subsequently, cold rolling was performed for this plate until the thickness became 0.75 mm, and an intermediate heat treatment was performed for the resultant plate at 350° C. for two hours. Final cold rolling was then performed to form a plate 0.6 mm thick.

Thereafter, in order to improve the ductility (tensile strength) of the plate, a heat treatment was performed at 150° C. for four hours, yielding a final plate.

This final plate was observed by using a transmission electron microscope, and an image analysis was performed to examine the dispersion state of transition-element intermetallic compounds 0.01 to 0.05 μm in diameter. In addition, the tensile strength of the final plate was checked at 250° C., and the crystal grain size after diffusion joining was also checked. Subsequently, an input window of an X-ray image intensifier was formed from this plate, and an X-ray image intensifier was manufactured by assembling the input window into it. The quality of a visible-light image obtained by this X-ray image intensifier was also evaluated. The method of evaluating the image quality was as follows.

Figure 6:
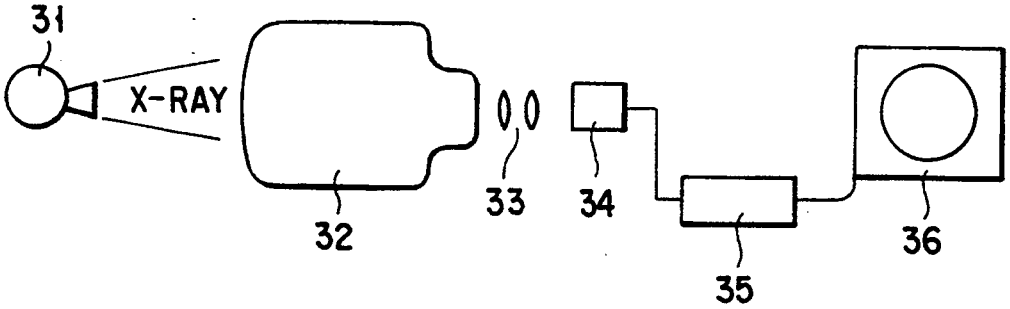
FIG. 6 is a view showing a system used to evaluate image qualities.

The image quality evaluation was performed by using a system shown in FIG. 6. X-rays emitted from an X-ray tube 31 are guided into an X-ray image intensifier 32 and converted into a visible-light image in it. This visible-light image is imaged by a TV camera 34 through a tandem optical system 33. An image signal from the TV camera 34 is processed by a digital image processor 35 and displayed on a TV monitor 36. Although several different types of digital image processing were used, two of them are explained herein.

(1) Averaging

A plurality of images are successively input and averaged in units of pixels. When TV signals of still images are averaged in this fashion, random noise components that the signals carry cancel one another out, resulting in images with less noise.

(2) Image emphasis

A certain portion of an image having gradation is enlarged and displayed on the TV monitor. This makes it possible to visually check small changes in gradation.

Figure 7:
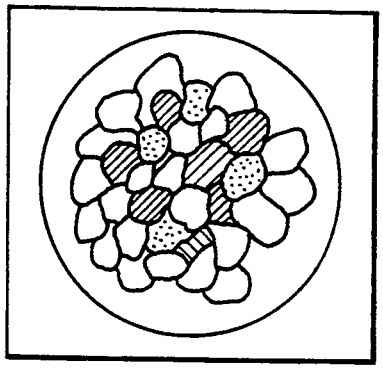
FIG. 7 is a view showing "unevenness" appearing on a TV monitor.

By performing the above image processing, smaller gradation changes can be detected without being covered with noise. When observation was performed in accordance with the above method by using a conventional X-ray image intensifier using X-rays with an energy of 50 KeV, no "unevenness" was observed even after the image processing was performed. When X-rays with an energy of 20 KeV were used, on the other hand, "unevenness" was observed after the image processing. FIG. 7 shows the "unevenness" appearing on the TV monitor.

Figure 8:
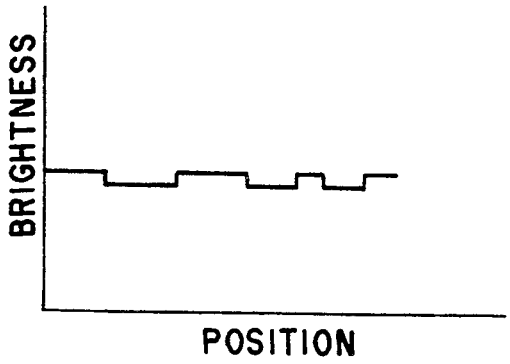
FIG. 8 is a graph showing the brightness on a scan line running in a central portion of the TV monitor.

In addition, when the brightness of a scan line running in a central portion of the TV monitor is plotted, the consequent curve is nonuniform as shown in FIG. 8.

The test results are summarized in the table below.

TABLE

| No. | Alloy components (wt %) Mg | Zr | Mn | Cr | Dispersion state of transition-element compounds (number/$\mu m^3$) | Crystal grain size (average: μm) | Strength at 250° C. (MPa) | Quality of X-ray image | Remarks |
|---|---|---|---|---|---|---|---|---|---|
| 1. | 3.0 | 0.15 | — | — | 15 | 20 | 120 | o | Present |
| 2. | 5.0 | 0.05 | 0.4 | 0.01 | 8 | 30 | 170 | o | invention |
| 3. | 3.5 | 0.20 | 0.2 | — | 20 | 20 | 127 | o | |
| 4. | 5.7 | 0.10 | — | 0.3 | 18 | 20 | 150 | o | |
| 5. | 5.0 | — | 0.4 | — | 0 | 2000 | 170 | x | Comparative |
| 6. | 5.0 | 0.007 | 0.4 | 0.25 | 3 | 1000 | 170 | x | example |
| 7. | 2.2 | 0.15 | 0.8 | — | 15 | 30 | 110 | — | |
| 8. | 5.0 | 0.6 | — | — | 39 | 15 | 170 | x | |
| | | | | | *$Al_3Zr$ compounds of size exceeding 100 μm were found | | | | |

The above table reveals the following. That is, each of sample Nos. 1 to 4 had a crystal grain size of 30 μm or less after diffusion joining, and the quality of each resulting visible-light image obtained by the X-ray image intensifier was high. In addition, each sample had a material strength of 120 MPa or more and hence could be formed into a thin plate.

In contrast, since sample No. 5 was not added with Zr, crystal grains grew into coarse grains after diffusion joining to impair the consequent image quality. Sample No. 6 was added with only a small amount of Zr, and so the same problem as with sample No. 5 arose. Since the addition amount of Mg was small in sample No. 7, its material strength at 250° C. was low, and consequently the input window deformed upon evacuation of the X-ray image intensifier. Also, since the addition amount of Zr was too large in sample No. 8, $Al_3Zr$ compounds of a size of 100 μm or more were formed. As a result a density unevenness was found in a visible-light image obtained by the X-ray image intensifier.

According to the present invention as has been described above, it is possible to realize an X-ray image intensifier capable of forming high-quality images free from unevenness even with low-energy X-rays.

What is claimed is:

1. An X-ray image intensifier comprising:

an envelope having an input window consisting essentially of an aluminum alloy; and an input phosphor screen arranged in said envelope to oppose said input window, and including a substrate, an input phosphor layer formed on said substrate, and a photocathode formed on said input phosphor layer, wherein said aluminum alloy contains 3 to 6 wt % of Mg and 0.01 to 0.5 wt % of Zr.

2. An image intensifier according to claim 1, wherein said aluminum alloy contains 4 to 5 wt % of Mg and 0.05 to 0.2 wt % of Zr.

3. An image intensifier according to claim 1, wherein said aluminum alloy contains at least one metal element selected from the group consisting of 0.1 to 1 wt % of Mn, 0.01 to 0.5 wt % of Cr, 0.01 to 0.5 wt % of Sc, and 0.01 to 0.05 wt % of Ti.

4. An intensifier according to claim 1, wherein said aluminum alloy contains at least one metal element selected from the group consisting of 0.3 to 0.6 wt % of Mn, 0.05 to 0.2 wt % of Cr, 0.05 to 0.2 wt % of Sc, and 0.01 to 0.03 wt % of Ti.

5. An intensifier according to claim 1, wherein said aluminum alloy contains not less than five particles of intermetallic compound with an average diameter of 0.01 to 0.05 $\mu m$ per $\mu m^3$.

6. An image intensifier according to claim 1, wherein said aluminum alloy has a material strength of not less than 120 MPa at not more than 250° C.

7. An image intensifier according to claim 1, wherein the crystal grain size is not more than 30 $\mu m$ when a heat treatment is performed at 530° C. for less than one hour.

8. An X-ray image intensifier comprising:

an envelope having an input window consisting essentially of an aluminum alloy; and an input phosphor screen arranged in said envelope to oppose said input window, and including a substrate, an input phosphor layer formed on said substrate, and a photocathode formed on said input phosphor layer, wherein said aluminum alloy contains 3 to 6 wt % of Mg, 0.01 to 0.5 wt % of Zr, 0.1 to 0.4 wt % of Fe, 0.05 to 0.2 wt % of Si, and 0.1 to 1 wt % of Mn.

9. An image intensifier according to claim 1, wherein said alu-minum alloy contains 4 to 5 wt % of Mg, 0.05 to 0.2 wt % of Zr, 0.1 to 0.4 wt % of Fe, 0.05 to 0.2 wt % of Si, and 0.3 to 0.6 wt % of Mn.

10. An image intensifier according to claim 8, wherein said alu-minum alloy contains at least one metal element selected from the group consisting of 0.01 to 0.5 wt % of Cr, 0.01 to 0.5 wt % of Sc, and 0.01 to 0.05 wt % of Ti.

11. An image according to claim 8, wherein said aluminum alloy contains at least one type of metal element selected from the group consisting of 0.3 to 0.6 wt % of Mn, 0.05 to 0.2 wt % of Cr, 0.05 to 0.2 wt % of Sc, and 0.01 to 0.03 wt % of Ti.

12. An image intensifier according to claim 8, wherein said aluminum alloy contains not less than five particles of intermetallic compound with an average diameter of 0.01 to 0.05 $\mu m$ per $\mu m^3$.

13. An image according to claim 8, wherein said aluminum alloy has a material strength of not less than 120 MPa at not more than 250° C.

14. An image intensifier according to claim 8, wherein the crystal grain size is not more than 30 $\mu m$ when a heat treatment is performed at 530° C. for less than one hour.

15. An X-ray image intensifier comprising:

an envelope having an input window consisting essentially of an aluminum alloy; and an input phosphor screen arranged in said envelope to oppose said input window, and including a substrate, an input phosphor layer formed on said substrate, and a photocathode formed on said input phosphor layer, wherein said aluminum alloy contains 3 to 6 wt % of Mg, 0.01 to 0.5 wt % of Zr, 0.1 to 0.4 wt % of Fe, 0.05 to 0.2 wt % of Si, and 0.1 to 1 wt % of Mn and at least one metal element selected from the group consisting of 0.01 to 0.5 wt % of Cr, 0.01 to 0.5 wt % of Sc, and 0.01 to 0.05 wt % of Ti, contains not less than five particles of intermetallic compound with an average diameter of 0.01 to 0.05 $\mu m$ per $\mu m^3$, and has a material strength of not less than 120 MPa at not more than 250° C., and the crystal grain size is not more than 30 $\mu m$ when a heat treatment is performed at 530° C. for less than one hour.

16. An image intensifier according to claim 15, wherein said aluminum alloy contains 4 to 5 wt % of Mg, 0.05 to 0.2 wt % of Zr, 0.1 to 0.4 wt % of Fe, 0.05 to 0.2 wt % of Si, 0.3 to 0.6 wt % of Mn and at least one metal element selected from the group consisting of 0.01 to 0.5 wt % of Cr, 0.01 to 0.5 wt % of Sc, and 0.01 to 0.05 wt % of Ti.

* * * * *